United States Patent [19]

Wearing et al.

[11] 4,230,921

[45] Oct. 28, 1980

[54] ELECTRIC SWITCH

[75] Inventors: Brian J. Wearing, North Weald; Syed M. A. Zaidi, Harrrow Weald, both of England

[73] Assignee: B.S.R. Limited of Monarch Works, Warley, England

[21] Appl. No.: 14,885

[22] Filed: Feb. 26, 1979

[30] Foreign Application Priority Data

Feb. 28, 1978 [GB] United Kingdom ..... 7978/78

[51] Int. Cl.[3] ..... H01H 3/52

[52] U.S. Cl. ..... 200/153 J; 200/328

[58] Field of Search ..... 200/153 J, 322, 325, 200/328; 74/503

[56] References Cited

U.S. PATENT DOCUMENTS

| | | | |
|---|---|---|---|
| 2,945,111 | 7/1960 | McCormick | 200/153 J X |
| 3,402,379 | 9/1968 | Amis, Jr. et al. | 200/153 J X |
| 3,523,168 | 8/1970 | Holmes | 200/153 J X |
| 3,694,603 | 9/1972 | Congelliere et al. | 200/153 J |
| 3,790,734 | 2/1974 | Raab et al. | 200/153 J |

FOREIGN PATENT DOCUMENTS

| | | | |
|---|---|---|---|
| 1362299 | 4/1964 | France | 200/153 J |

*Primary Examiner*—Stephen Marcus

*Attorney, Agent, or Firm*—Berman, Aisenberg & Platt

[57] ABSTRACT

In a push-push switch a contact carrier is provided which carries a contact member movable to and from a position in which it touches two terminals. The contact carrier member is provided with a central ribbed boss movable in a channel defined by co-operating axially extending ribs, the lowermost surface of the boss being serrated to cause rotation of a rotatable member having arms which engage the serrations or movement thereof by the push-button. The arms, in one position can pass freely past the ribs, and in another position engage a stop surface on the ribs, thus retaining the contact carrier member in a lower position in which the switch is closed. A first spring biasses the rotatable member upwardly and a second spring biasses the contact carrier downwardly.

8 Claims, 9 Drawing Figures

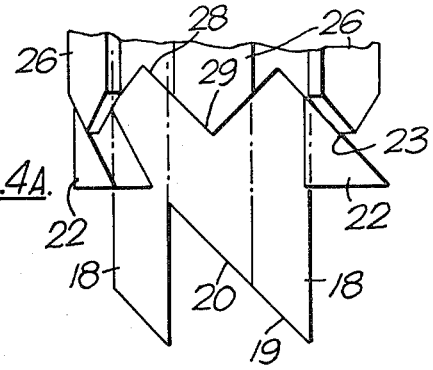
Fig.4A.
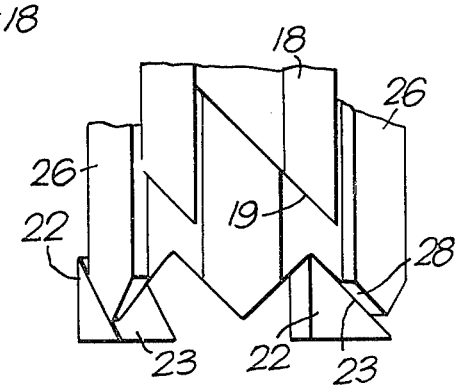
Fig.4B.
Fig.4C.
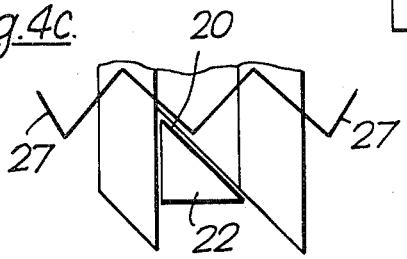
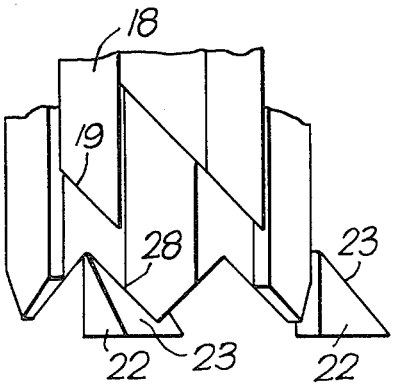
Fig.4D.
Fig.4E.
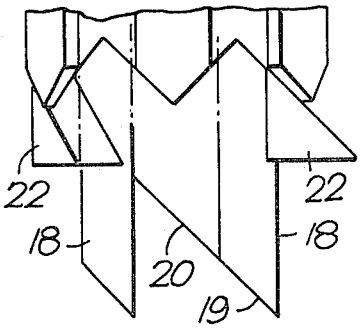

ELECTRIC SWITCH

BACKGROUND OF THE INVENTION

This invention relates to an electric switch and more particularly the invention relates to a push-button switch which is adapted to be opened and closed by successive operations of the push-button. Such a switch may be termed a "push-push" switch and the switch is moved from a circuit completing position to a circuit breaking position by pushing the push-button, and is subsequently returned from the circuit breaking position to the circuit completing position by again pushing the push-button.

OBJECT OF THE INVENTION

It has been proposed to provide an electric switch adapted to be opened and closed by successive operations of a push-button, said switch comprising a housing containing two fixed terminal members, a push-button protruding from the housing and movable axially into the housing against the bias of a spring, a rotatable member movable axially in response to movement of said button, radially projecting arms on the rotatable member defining cam surfaces, guide ribs formed within the housing and located to co-operate with the said projecting arms to guide said arms during part of the axial movement of the rotatable member, said ribs terminating with cam surfaces, stop surfaces located between some respective pairs of the ribs to restrict axial movement of said rotatable member when said arms are located between said respective pairs of ribs, further means carrying cam surfaces and movable in response to movement of the push-button, the cam surfaces of said further means being adapted to engage the cam surfaces of the rotatable member on each depression of the button to move said arms of the rotatable member axially from between said ribs and subsequently to rotate said rotatable member, and an electric contact member movable with said rotatable member between a first position in which the contact member touches the contact terminals, and a second position in which the contact member does not touch the contact terminals.

A prior proposed switch of this type is disclosed in British patent specification No. 1,142,603. In the switch disclosed in that prior British patent specification the further means carrying cam surfaces are in the form of radially protruding teeth provided on the push-button. The rotatable member comprises a head which carries the radially projecting arms, and a stem that extends vertically upwardly and is received within a corresponding bore provided within the push-button. The stem must be a tight fit within this bore to ensure that the head moves axially and does not become jammed, but this tight fit of the stem may prevent rotation of the rotatable member, thus causing the switch to malfunction. Also in the disclosed switch the rotatable member is located above the contact member, and the contact member, the rotatable member, and the push-button are biassed upwardly by a single spring located between the contact member and the base of the housing. The single spring must have sufficient strength to force the contact member firmly into contact with the terminals and thus this spring may prove difficult to compress when the push-button is pushed.

SUMMARY OF THE INVENTION

The present invention seeks to provide an improved switch of the "push-push" type which is easy to manufacture but which is reliable in operation and which has a satisfactory operation.

According to this invention there is provided an electric switch adapted to be opened and closed by successive operations of a push-button, said switch comprising a housing containing two fixed terminal members, a push-button protruding from the housing and movable axially into the housing against the bias of a spring, a rotatable member movable axially in response to movement of said button, radially projecting arms on the rotatable member defining cam surfaces, guide ribs formed within the housing and located to co-operate with the said projecting arms to guide said arms during part of the axial movement of the rotatable member, said ribs terminating with cam surfaces, stop surfaces located between some respective pairs of the ribs to restrict axial movement of said rotatable member when said arms are located between said respective pairs of ribs, further means carrying cam surfaces and movable in response to movement of the push-button, the cam surfaces of said further means being adapted to engage the cam surfaces of the rotatable member on each depression of the button to move said arms of the rotatable member axially from between said ribs and subsequently to rotate said rotatable member, and an electric contact member movable with said rotatable member between a first position in which the contact member touches the contact terminals, and a second position in which the contact member does not touch the contact terminals, wherein the said electric contact member is carried by a contact carrier which comprises said further means comprising cam surfaces, and the rotatable member is located on the opposite side of the contact carrier to the said push-button, and a first spring is provided to bias the rotatable member and the contact carrier away from said terminals and a second spring is provided to bias the said contact carrier towards said terminals, and the arrangement is such that when the switch is in an initial condition in which the projecting arms engage with said stop surfaces the contact carrier is retained in a first predetermined position in which the contact member touches the contact terminals, subsequent depression of the push-button causing the cam surfaces of the contact carrier to engage the corresponding cam surfaces of the arms of said rotatable member to rotate said rotatable member whilst moving the rotatable member against the bias of the first spring, subsequent release of the push-button permitting the rotatable member to be moved by the bias of the first spring, against the bias of the second spring, the rotatable member being further rotated by engagement of the cam surfaces of said arms with the cam surfaces defined by the guide ribs of the housing to a position in which the rotatable member is free to move axially in response to the bias of the first spring, the contact carrier thus being moved to a second position in which the contact member does not touch the contact terminals, the switch being returnable to its first condition by a subsequent depression and release of the push-button, which causes further rotation of the rotatable member so that the arms of the rotatable member again engage the stop surfaces.

In the preferred embodiment of the invention, since the rotary member is located on the opposite side of the contact carrier to the button, the button can act directly on the contact carrier, although preferably the second spring is located between the push-button and the contact carrier. Since the contact carrier is provided with cam surfaces which serve to effect rotation of the rotatable member, there is no need to provide a rotary member having a stem located within a bore which can tend to jam. Also, since two springs are provided, one spring biassing the rotary member and the contact carrier upwardly, and the second spring serving to bias the contact carrier downwardly, the contact carrier will move smoothly.

Preferably the housing is formed of a base and a cover, and said contact terminals are provided in the base of the housing. Advantageously the base of the housing is provided with a spigot and said first spring comprises a compression spring mounted on said spigot. Preferably the rotatable member with the extending arms is a generally cylindrical member, with four equally circumferentially spaced radially extending arms, which is mounted on the other end of said first compression spring.

Advantageously the housing defines two upstanding fingers which surround the first spring and which are arcuate in plan, the fingers having a common radius of curvature and a common centre of curvature, said guide ribs being formed on the innermost surfaces of said arcuate fingers, the lower surfaces of said guide ribs being inclined to form said cam surfaces.

Advantageously the contact carrier member comprises a central boss which is provided with ribs adapted to interengage with said guide ribs, so that said boss may slide freely in the space defined between said two arcuate fingers, the boss being provided with two radially extending arms which extend from the boss through the spaces between the arcuate fingers, one of said arms carrying said contact member. Preferably the contact member comprises a metallic strip which is biassed in the direction towards said terminals by a spring.

Conveniently at least one of said two radially extending arms may be provided with a housing thereon which defines a substantially square aperture, said contact strip being located within said aperture and protruding beyond the ends of the aperture, the ends of the contact strip being resiliently biassed towards the contact terminals by means of respective springs.

Preferably both said arms carry respective contact members there being four terminals located in the housing so that the switch constitutes a two-pole switch.

Advantageously the said second spring is located between the push-button and the contact carrier member to bias the push-button upwardly and to bias the carrier member downwardly, the movement of the push-button being transmitted to the contact carrier by the said second spring. Preferably the push-button is also provided with an internal spigot adapted to contact the contact carrier member when the push-button is fully depressed.

BRIEF DESCRIPTION OF THE DRAWINGS

In order that the invention may be more readily understood, and so that further features thereof may be appreciated, the invention will now be described by way of example, with reference to the accompanying drawings in which:

FIGS. 4A–4E are partial schematic views taken on the line IV—IV of FIG. 2 illustrating the lower part of the ribs on the housing, the arms on the rotary member and the cam surfaces on the contact carrier in various positions during a cycle of operation of the switch.

DESCRIPTION OF PREFERRED EMBODIMENTS

Figure 1:
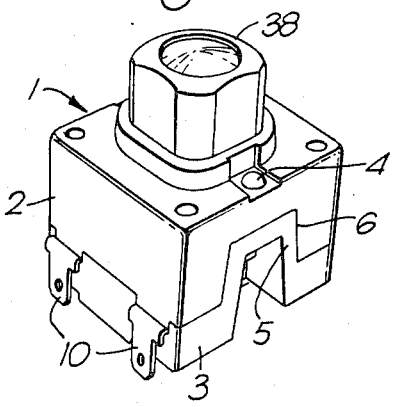
FIG. 1 is a perspective view of a switch in accordance with the present invention.
Figure 2:
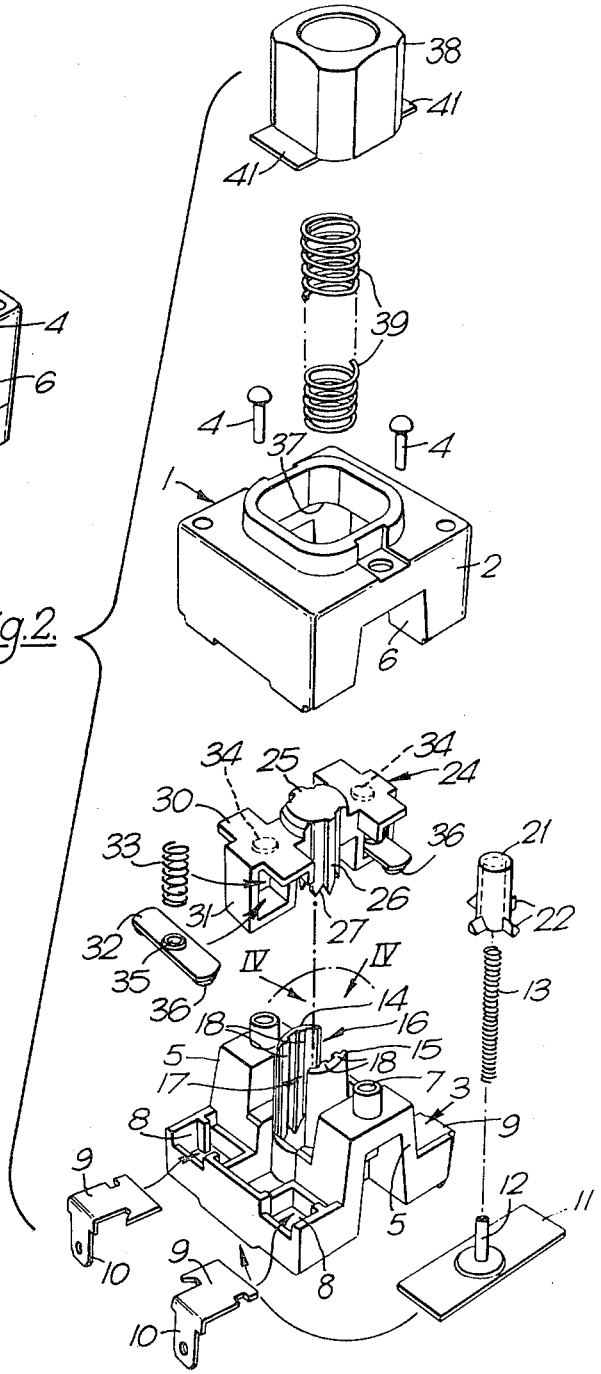
FIG. 2 is an exploded perspective view of the switch of FIG. 1.
Figure 3:
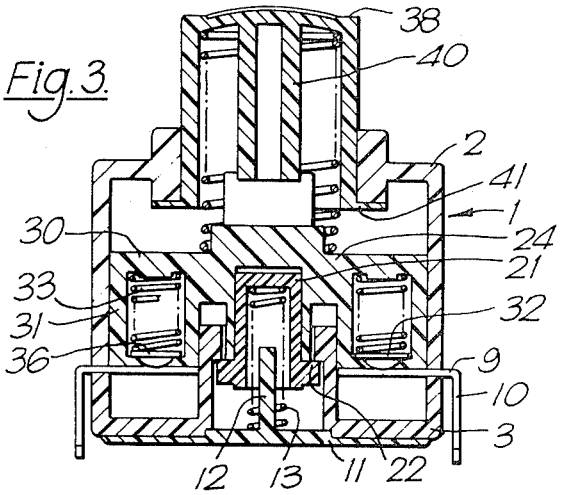
FIG. 3 is a cross-sectional view of the switch of FIG. 1.

The illustrated embodiment of a switch 1 is intended for use in switching mains voltage domestic electricity, e.g. 240 volt 50 cycle per second AC. The particular embodiment described in a two-pole switch, that is to say a switch adapted to make and break both a live connection and a neutral connection simultaneously. However, the switch can readily be adapted to be utilised as a single-pole switch.

The switch comprises a housing 1 formed of an insulating plastics material and which comprises an upper part 2 and a lower part 3, the two parts being held together by means of rivets 4, or the like which pass through appropriate bores 7 in the two housing parts.

The lower part of the housing 3 is substantially rectangular in plan and is provided, in the middle regions of two opposed sides, with two upwardly extending portions 5, which are adapted to engage with corresponding recesses 6 formed in the upper part 2 of the housing 1, these upwardly extending portions 5 being provided with the bores 7 adapted to accommodate the rivets 4. Adjacent each corner of the substantially square lower portion 3 of the housing is a recess 8 which is adapted to accommodate a substantially planar metallic contact terminal member 9. Each member 9 is associated with a spade 10 cranked therefrom. The recesses 8 in the housing member 3 and the terminal members 9 are so shaped that, when the terminal members 9 are in position each terminal member 9 lies at least partly within the corresponding recess and is substantially securely located in position. The periphery of each recess 8 is provided with various indentations or protrusions, and corresponding protrusions or indentations are provided on the periohery of the terminal member 9. The spade 10 of each terminal member protrudes beyond the edge of the housing to enable an appropriate connector member to be connected thereto. When the four terminal members 9 are in position the housing has a substantially symmetrical appearance.

Secured to the lowermost surface of the base 3 of the housing, for example, by sonic welding, is a plate 11 which carries a central upstanding spigot 12. When the plate is in position the spigot 12 is located centrally of the housing. A helical compression spring 13 surrounds the spigot and extends upwardly through a portion of the lowermost part 3 of the housing that defines a tube. Two arcuate fingers 14, 15 extend upwardly from the top of the tube, the arcuate fingers having a common radius of curvature and a common centre of curvature so that the arcuate fingers 14, 15, effectively form a continuation of the tube. Thus the combination of the tube and the arcuate fingers 14, 15 could be considered to be a single tube having two opposed longitudinal portions 16, 17, thereof cut away.

Provided on the interior of each of the arcuate fingers 14, 15, are two radially inwardly directed axially extending ribs 18. The thickness of each arcuate finger between the two ribs therefrom is slightly greater than the thickness of each arcuate finger between each rib and the free peripheral edge of the arcuate finger. This thicker portion of each arcuate finger defines a stop surface 20 adjacent the lower end of each rib as will be described hereinafter in greater detail.

As can be seen most clearly from FIG. 4, which illustrates the shape of the lower portion of the ribs 18, the lowermost surface 19 of each rib 18 is inclined to the horizontal and, as shown in FIG. 4 is inclined upwardly and towards the left when looking radially inwardly towards the centre of the housing. The relatively thick portion of the arcuate finger between the ribs 18, defines the stop surface 20 mentioned above.

A rotary member 21 is provided in the form of a hollow cylindrical member which is closed at one end and which is mounted on top of the spring 13. This spring 13 extends into the cavity defined by the tube formed in the housing and the arcuate fingers 14, and 15. The rotary member 21 is able to rotate and to move upwardly and downwardly and the rotary member is provided with four equi-angularly spaced radially extending arms 22 adjacent the base thereof. Each of the arms is substantially triangular in section and has a horizontal base, one vertical side wall, and one inclined side wall. Other shapes for the arms are possible, but each arm 22 must have at least part of one side wall inclined to form a cam surface 23. The arrangement is such that when each of the arms is viewed towards the axis of the switch the inclined upper cam surface 23 of each arm is inclined upwardly and towards the left, and the angle of inclination of the upper cam surface 23 of each arm 22 is substantially identical to the angle of inclination of the previously described lower surfaces 19 of the ribs 18 provided on the arcuate fingers 14, 15.

The rotary member 21 may be inserted between the arcuate fingers 14, 15 in such a way that each of the arms 22 on the rotary member 21 lies adjacent one of the above described ribs 18 and in this case arm 22 lies between a rib 18 and the adjacent free edge of the arcuate finger 14 or 15 supporting the rib. The rotary member then may thus move freely upwardly and downwardly when in this position.

A contact carrier member 24 is also mounted for movement between the two arcuate fingers 14, 15. The contact carrier member 24 is provided with a central hollow cylindrical boss 25 that is closed at the upper end thereof and that is provided with radially outwardly directed ribs 26 that extend axially on the outer cylindrical surface thereof, the ribs 26 being adapted to be accommodated between the ribs 18 on the arcuate fingers 14, 15. The arrangement is such that the boss 26 can slide freely upwardly and downwardly between the arcuate fingers 14, 15, but is not able to rotate when located between the arcuate fingers 14, 15 as a result of the interengagement of the ribs 26 and 18.

Figure 5:
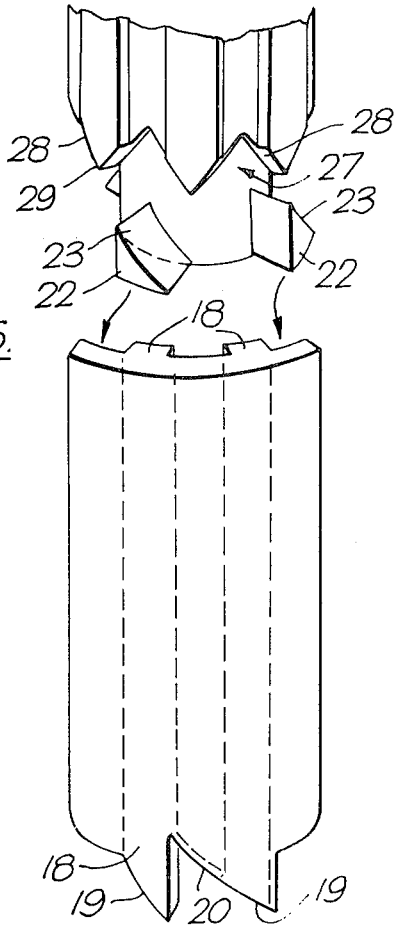
FIG. 5 is an exploded part cut away view of part of the switch on an enlarged scale.

The annular lowermost surface of the boss 25 is serrated 27 and as can be most clearly seen from FIG. 4 or 5 defines cam surfaces 28 for co-operation with the cam surfaces 23. The serrations 27 extend around the entire lower periphery of the boss 25. The arrangement is such that each rib 26 provided on the boss ends in a point 29 and the end faces of the rib extends upwardly away from the axis of the rib on each side of the point 29. These upwardly inclined faces continue and meet substantially in the middle of the recess or depression between adjacent ribs 26.

Protruding from the boss 25 of the contact carrier 24 are two radially outwardly directed arms 30, the arms being radially opposed. Each arm is provided with a substantially "U" shaped housing 31 suspended beneath the arm to define a substantially rectangular cavity. A metallic contact strip 32 is located within the cavity, adjacent the base thereof, and is biassed towards the base of the cavity by means of a spring 33 which extends between the metallic contact strip and the lowermost surface of the arm 31. A protrusion 34 may be provided on the lowermost surface of the arm 31, and a corresponding protrusion 35 may be provided on the strip 32 to locate the spring 33 in position.

The contact strip 32 may also be provided with two downwardly protruding portions 36 each end thereof, the protruding portions extending downwardly beneath the "U" shaped housing 31 defining the cavity so that the portions 36 can touch the contact terminals 9 which are located beneath the contact strip 32.

The upper portion 2 of the housing defines an open aperture 37 through which protrudes a push-button 38, the push-button 38 being movable into the housing 1 against the bias of a compression spring 39 that is located between the push-button 38 and the contact carrier member 24. A central spigot 40 is provided within the push-button 38 which can contact the carrier member when the button is fully depressed. The push-button 38 is also provided with outwardly directed flanges at the base thereof to engage the edges of aperture 27 to retain the push-button 38 in position.

The operation of the switch will now be described with reference to FIG. 4 which illustrates the ribs 18 on one of the arcuate fingers 14, 15, the ribs 26 and cam surfaces 28 on the contact carrier and the arms 22 of the rotatable member 21 in the positions occupied at various stages of the operational cycle of the switch.

Referring to FIG. 4A, the ribs 18 of one of the arcuate fingers are shown, and the thickened portion of the arcuate finger defining the stop surfaces 20 between the ribs is shown, but the rest of the arcuate finger is omitted for the sake of clarity. A portion of the boss 25 of the contact carrier is shown, the portion of the ribs 18 that would otherwise mask this boss being omitted, since the boss is of course, on the interior side of the ribs 18.

In FIG. 4A the switch is shown in the "off" condition and it is to be noted that in this position of the apparatus the arms 22 of the rotatable member 21 are located on either side of the ribs 18 and are not located between the ribs. Thus the rotatable member is free to slide axially adjacent the ribs 18 and is biassed upwardly by the spring 13. Since the spring 13 is stronger than the spring 39, the boss 25 of the contact carrier 24 is also moved upwardly to the position illustrated in FIG. 4A, and thus the contact strips 32 do not touch the contact terminals 9. When the switch is to be turned on, the button 38 is depressed, thus compressing spring 39 and consequently causing the contact carrier to move downwardly. When the button is fully depressed the spigot 40 will touch the contact carrier 24. As the contact carrier moves downwardly, so the cam surfaces 28 defined by the serrated edge at the bottom of the ribs 26 engage the cam surfaces 23 of the arms 22 of the rotatable member and force these arms downwardly until the arms pass below the level of the lowermost points of the ribs 18. At this point the contact strips 32 are in form contact with the terminals 9 and springs 33 are fully compressed. When the switch is in this condition, since the cam surface 23 on each arm 22 of the rotatable member is pressed upwardly by the spring 13 against the corresponding cam surface 28 on the boss 25 of the contact carrier 24, and since the rotary member is not prevented from rotation by engagement of the arms 22 with ribs 18 the rotary member 21 will tend to move upwardly with a corresponding rotation of the rotatable member, this rotation continuing until the uppermost part of each arm 23 engages in the uppermost part of the corresponding serration of the lower serrated edge of the boss 25 of the contact carrier 24. This is the condition of the apparatus illustrated in FIG. 4B. When the apparatus is in this condition the contact carrier is substantially at its lowermost point and the contact strips 32 are in firm contact with the contact terminals 9, the springs 33 being compressed.

When the button is released the contact carrier will move upwardly both under the influence of the force applied to it by the rotary member 21 by virtue of the compressed spring 13 and by virtue of the force applied to it by the compressed spring 33. As the boss 25 moves upwardly so the cam surface 23 of the illustrated arm of the rotary member moves upward and engages the sloping cam surface 19 of the rib 18 shown to the right in FIG. 4B. The contact carrier member will continue to move upwardly, but the engaging cam face 23 of the arm of the rotary member 22 and cam face 19 of the rib 18 will cause the rotary member to execute an upward and rotating motion until the arm 22 of the rotary member is checked by the stop surface 20. This is the condition of the switch as illustrated in FIG. 4C, the position of the contact carrier 24 merely being indicated by a serrated line identifying the position of the bottom part of the boss 25. When the switch is in this condition the contact strips 32 are still pressed firmly against the contact terminals 9 by the compressed springs 33, and thus the switch is in the "on" condition.

When the button 38 is again pressed, the spring 39 is again compressed and the spigot 40 contacts the top of the contact carrier member 24 to move the contact carrier downwardly, and again the cam surface 28 of the contact carrier member engages the cam surface 23 of the arm 22 of the rotary member moving that arm initially downwardly and then causing the rotary member to rotate when the arm 22 passes below the lowermost portion of the rib 18. As the contact member again moves upwardly the cam surface 23 of the arm 22 will engage with the cam surface 19 at the bottom of the left hand rib is illustrated in FIG. 4D and the rotary member will be rotated so that the arms thereof are adjacent the ribs 18 rather than between the ribs 18 and thus the rotary member can move upwards. As the contact carrier member continues to move upwardly so the switch is returned to its initial condition as illustrated in FIG. 4E, the original arm 22 shown at the right in FIG. 4A now being shown at the left hand side of the drawing and the fresh arm 22 automatically being brought into position at the right hand side of the drawing so that the operational cycle can be repeated.

From the above description it will be appreciated that the switch may be operated many successive times, the switch operating smoothly and with a satisfactory "feel". Whilst the invention has been described with reference to a bi-polar switch in which two contact strips 32 are provided, the invention may also be applied to a single pole switch in which only one pair of terminals 9 and one contact strip 32 is provided.

We claim:

1. An electric switch adapted to be opened and closed by successive operations of a push-button, said switch comprising a housing containing two fixed terminal members, a push-button protruding from the housing and movable axially into the housing against the bias of a spring, a rotatable member movable axially in response to movement of said button, radially projecting arms on the rotatable member defining cam surfaces, guide ribs formed within the housing and located to co-operate with the said projecting arms to guide said arms during part of the axial movement of the rotatable member, said ribs terminating with cam surfaces, stop surfaces located between some respective pairs of the ribs to restrict axial movement of said rotatable member when said arms are located between said respective pairs of ribs, further means carrying cam surfaces and movable in response to movement of the push-button, the cam surfaces of said further means being adapted to engage the cam surfaces of the rotatable member on each depression of the button to move said arms of the rotatable member axially from between said ribs and subsequently to rotate said rotatable member, and an electric contact member movable with said rotatable member between a first position in which the contact member touches the contact terminals, and a second position in which the contact member does not touch the contact terminals, wherein the said electric contact member is carried by a contact carrier which comprises said further means comprising cam surfaces, and the rotatable member is located on the opposite side of the contact carrier to the said push-button, and a first spring is provided to bias the rotatable member and the contact carrier away from said terminals and a second spring is provided to bias the said contact carrier towards said terminals, said housing defining two upstanding fingers which surround the first spring and which are arcuate in plan, the fingers having a common radius of curvature and a common centre of curvature, said guide ribs being formed on the innermost surfaces of said arcuate fingers, the lower surfaces of said guide ribs being inclined to form said cam surfaces, and the arrangement is such that when the switch is in an initial condition in which the projecting arms engage with said stop surfaces the contact carrier is retained in a first predetermined position in which the contact member touches the contact terminals, subsequent depression of the push-button causing the cam surfaces of the contact carrier to engage the corresponding cam surfaces of the arms of said rotatable member to rotate said rotatable member whilst moving the rotatable member against the bias of the first spring, subsequent release of the push-button permitting the rotatable member to be moved by the bias of the first spring, against the bias of the second spring, the rotatable member being further rotated by engagement of the cam surfaces of said arms with the cam surfaces defined by the guide ribs of the housing to a position in which the rotatable member is free to move axially in response to the bias of the first spring, the contact carrier thus being moved to a second position in which the contact member does not touch the contact terminals, the switch being returnable to its first condition by a subsequent depression and release of the push-button, which causes further rotation of the rotatable member so that the arms of the rotatable member again engage the stop surfaces.

2. A switch according to claim 1 wherein the rotatable member with the extending arms is a generally cylindrical member, with four equally circumferentially spaced radially extending arms, which is mounted on the other end of said first compression spring.

3. A switch according to claim 1 wherein the contact carrier member comprises a central boss which is provided with ribs adapted to interengage with said guide ribs, so that said boss may slide freely in the space defined between said two arcuate fingers, the boss being provided with two radially extending arms which extend from the boss through the spaces between the arcuate fingers, one of said arms carrying said contact member.

4. A switch according to claim 3 wherein both said arms carry respective contact members there being four terminals located in the housing so that the switch constitutes a two pole switch.

5. A switch according to claim 3 wherein the contact member comprises a metallic strip which is biassed in the direction towards said terminals by a spring.

6. A switch according to claim 5 wherein at least one of said two radially extending arms is provided with a housing thereon which defines a substantially square aperture, said contact strip being located within said aperture and protruding beyond the ends of the aperture, the ends of the contact strip being resiliently biassed towards the contact terminals by means of a respective spring.

7. An electric switch adapted to be opened and closed by successive operations of a push-button, said switch comprising a housing containing two fixed terminal members, a push-button protruding from the housing and movable axially into the housing against the bias of a spring, a rotatable member movable axially in response to movement of said button, radially projecting arms on the rotatable member defining cam surfaces, guide ribs formed within the housing and located to co-operate with the said projecting arms to guide said arms during part of the axial movement of the rotatable member, said ribs terminating with cam surfaces, stop surfaces located between some respective pairs of the ribs to restrict axial movement of said rotatable member when said arms are located between said respective pairs of ribs, further means carrying cam surfaces and movable in response to movement of the push-button, the cam surfaces of said further means being adapted to engage the cam surfaces of the rotatable member on each depression of the button to move said arms of the rotatable member axially from between said ribs and subsequently to rotate said rotatable member, and an electric contact member movable with said rotatable member between a first position in which the contact member touches the contact terminals, and a second position in which the contact member does not touch the contact terminals, wherein the said electric contact member is carried by a contact carrier which comprises said further means comprising cam surfaces, and the rotatable member is located on the opposite side of the contact carrier to the said push-button, a first spring is provided to bias the rotatable member and the contact carrier away from said terminals and a second spring is provided to bias the said contact carrier towards said terminals, said second spring is located between the push-button and the contact carrier member to bias the push-button upwardly and to bias the carrier member downwardly, the movement of the push-button being transmitted to the contact carrier by the said second spring, and the arrangement is such that the switch is in an initial condition in which the projecting arms engage with said stop surfaces the contact carrier is retained in a first predetermined position in which the contact member touches the contact terminals, subsequent depression of the push-button causing the cam surfaces of the contact carrier to engage the corresponding cam surfaces of the arms of said rotatable member to rotate said rotatable member whilst moving the rotatable member against the bias of the first spring, subsequent release of the push-button permitting the rotatable member to be moved by the bias of the first spring, against the bias of the second spring, the rotatable member being further rotated by engagement of the cam surfaces of said arms with the cam surfaces defined by the guide ribs of the housing to a position in which the rotatable member is free to move axially in response to the bias of the first spring, the contact carrier thus being moved to a second position in which the contact member does not touch the contact terminals, the switch being returnable to its first condition by a subsequent depression and release of the push-button, which causes further rotation of the rotatable member so that the arms of the rotatable member again engage the stop surfaces.

8. A switch according to claim 7 wherein the push-button is also provided with an internal spigot adapted to contact the contact carrier member when the push-button is fully depressed.

* * * * *